US009260867B2

(12) United States Patent
Arnold

(10) Patent No.: US 9,260,867 B2
(45) Date of Patent: Feb. 16, 2016

(54) ANTI-SPALLING EDGING

(71) Applicant: Permaban Limited, Devon (GB)

(72) Inventor: Rodney Malcolm Arnold, Devon (GB)

(73) Assignee: Permaban Limited, Devon (GB)

( * ) Notice: Subject to any disclaimer, the term of this patent is extended or adjusted under 35 U.S.C. 154(b) by 0 days.

(21) Appl. No.: 14/381,769

(22) PCT Filed: Feb. 22, 2013

(86) PCT No.: PCT/GB2013/000071

§ 371 (c)(1),
(2) Date: Aug. 28, 2014

(87) PCT Pub. No.: WO2013/128151

PCT Pub. Date: Sep. 6, 2013

(65) Prior Publication Data

US 2015/0016870 A1 Jan. 15, 2015

(30) Foreign Application Priority Data

Feb. 29, 2012 (GB) ..... 1203580.4

(51) Int. Cl.

| | |
|---|---|
| ***E04C 5/16*** | (2006.01) |
| ***E01C 11/08*** | (2006.01) |
| ***E04C 5/18*** | (2006.01) |
| ***E01C 11/14*** | (2006.01) |
| ***E04B 1/48*** | (2006.01) |

(52) U.S. Cl.

CPC . *E04C 5/18* (2013.01); *E01C 11/08* (2013.01); *E01C 11/14* (2013.01); *E04B 1/483* (2013.01); *E04C 5/16* (2013.01); *Y10T 403/471* (2013.01)

(58) Field of Classification Search

CPC ..... E01C 11/08; E01C 11/14; E01C 11/04; E04B 1/483; E02D 29/16; E04C 5/16

See application file for complete search history.

(56) References Cited

U.S. PATENT DOCUMENTS

| | | | | | |
|---|---|---|---|---|---|
| 2,093,718 | A | * | 9/1937 | Fremont | 404/56 |
| 2,283,787 | A | * | 5/1942 | Brickman | 404/53 |
| 2,355,771 | A | * | 8/1944 | Yeoman | 404/53 |
| 2,419,022 | A | | 4/1947 | Heltzel | |
| 3,300,140 | A | * | 1/1967 | Moses et al. | 238/25 |
| 3,822,428 | A | * | 7/1974 | Stog et al. | 14/73.1 |
| 5,366,319 | A | * | 11/1994 | Hu et al. | 404/52 |

FOREIGN PATENT DOCUMENTS

| | | | | | |
|---|---|---|---|---|---|
| DE | 3726216 | A1 | * | 2/1989 | E04F 15/14 |
| DE | 19537444 | A1 | * | 4/1997 | E04B 1/68 |
| DE | 202012102396 | U1 | * | 9/2012 | |
| FR | 2785632 | A1 | * | 5/2000 | E04B 1/68 |
| GB | 2444781 | A | * | 6/2008 | E04G 21/10 |
| WO | WO 2004065694 | A1 | * | 8/2004 | E01C 11/14 |
| WO | WO 2005103412 | A1 | * | 11/2005 | E04F 15/14 |
| WO | WO 2007104922 | A1 | * | 9/2007 | E04B 1/68 |
| WO | WO 2010094910 | A1 | * | 8/2010 | E04C 5/16 |

* cited by examiner

*Primary Examiner* — Christine T Cajilig
(74) *Attorney, Agent, or Firm* — Bay State IP, LLC

(57) ABSTRACT

An anti-spalling edging comprising: a metal strip 21,31 adapted for concrete to be cast against, a return 22,32 along a top edge of the strip and forming a corner with the metal strip, a down-turn 23,33 from the edge of the return spaced from the strip and cut-outs in 26,36 the down-turn for anchoring it in the concrete and an elongate metallic member 201,202 extending in the corner, fixed to the strip and the return for reinforcement of the anti-spalling edge at the corner.

11 Claims, 6 Drawing Sheets

ANTI-SPALLING EDGING

CROSS REFERENCE TO RELATED APPLICATION

This application is for entry into the U.S. National Phase under §371 for International Application No. PCT/GB2013/000071 having an international filing date of Feb. 22, 2013, and from which priority is claimed under all applicable sections of Title 35 of the United States Code including, but not limited to, Sections 120, 363, and 365(c), and which in turn claims priority under 35 USC 119 to United Kingdom Patent Application No. 1203580.4 filed on Feb. 29, 2012.

BACKGROUND OF THE INVENTION

1. Field of the Invention

The present invention relates to an anti-spalling edging, in particular, though not exclusively for concrete.

2. Description of the Related Art

Concrete is strong in compression, but weak in tension. Small sections are liable to fail in shear. The result is that edges of concrete slabs are liable to spall, that is the edge is liable to crack away, generally at angle.

The problem can be relieved to an extent by a flat steel edging, with may form part of a joint allowing contraction of the slabs on setting and thermal expansion. Flat steel strip can become bent away from the concrete, thus the original problem is not really solved. The steel strip can be reinforced against such bending away by provision of an in-turned edge or return level with the top of the slab. This protects the edge of the slab, but loading, deflections and impact can allow the free edge of the return to lift. This gives rise to another set of problems. In turn the free edge can be turned down and provided with cut-outs for its anchoring in the slab.

Again there is a problem, in that the down-turn has a radius of curvature at its abutment with the top surface of the concrete, which creates yet another potential spalling site.

In our International Application No WO 2010/094910 (Our '910 Application), we have described and claimed an anti-spalling edging comprising:

- a metal strip adapted for concrete to be cast against,
- a return along a top edge of the strip,
- a down-turn from the edge of the return spaced from the strip,
- cut-outs in the down-turn for anchoring it in the concrete;

wherein:

- the cut-outs are so arranged as to provide faces, extending through the return and generally in the direction of the edging, against which faces the concrete abuts when cast level with the outer surface of the return.

In our '910 Application, we envisaged that anti-spalling advantage could be obtained if the faces were non-planar, such as being S or W shaped when viewed in plan, preferably the faces are flat and face directly away from a bend connecting the metal strip to the return. We preferred in the direction of the edging, the transverse faces to predominate compared with fingers of the down-turn extending down between the cut-outs.

We envisaged that the fingers might not joined at their distal ends, but we preferred to join them at their distal ends to stabilise them during installation and casting of the concrete. Members joining the fingers are important for holding the finger from drawing upwards of the concrete.

We envisaged that the metal strip would be of steel galvanised before or after is punching of its cut-outs. However, it could also be of stainless steel, mild steel or plastics materials.

In the preferred embodiment of our '910 Application, a pair of anti-spalling edgings were normally to be provided as a "joint" between two sections of concrete slab, the two metal strips abutting with the returns extending in opposite directions on laying of the concrete and separating on curing. The joint would normally include dowels extending into the two sections of the slab, for vertical load transfer in use; the dowels may be any type of dowels and indeed are optional. Furthermore, a single anti-spalling edging might be used, particularly at an edge.

In testing this joint with admittedly-heavy, localised repetitive loading, we have experienced impacting of the return below neighbouring regions of the edge and the concrete not subjected to the localised load.

SUMMARY OF THE INVENTION

The object of the present invention is to provide an improved anti-spalling edging.

According to the invention there is provided an anti-spalling edging comprising:

- a metal strip adapted for concrete to be cast against,
- a return along a top edge of the strip and forming a corner with the metal strip,
- a down-turn from the edge of the return spaced from the strip and
- cut-outs in the down-turn for anchoring it in the concrete
  - the cut-outs being so arranged as to provide faces, extending through the return and generally in the direction of the edging, against which faces the concrete abuts when cast level with the outer surface of the return and
- an elongate metallic member extending in the corner, fixed to the strip and/or the return for reinforcement of the anti-spalling edge at the corner.

Preferably as in Our '910 application the cut-outs being so arranged as to provide faces, extending through the return and generally in the direction of the edging, against which faces the concrete abuts when cast level with the outer surface of the return.

Normally the reinforcement will be substantially the same width as the return and welded into the corner. Whilst other sections can be envisaged such as triangular or square cross section complementary in shape to the shape of the corner, with close matching of radius of the inside corner of the metal strip, we prefer to use reinforcing bar, for its ready availability.

BRIEF DESCRIPTION OF THE DRAWINGS

To help understanding of the invention, specific embodiments thereof will now be described by way of example and with reference to the accompanying drawings, in which.

DETAILED DESCRIPTION OF THE PREFERRED EMBODIMENTS

Figure 1:
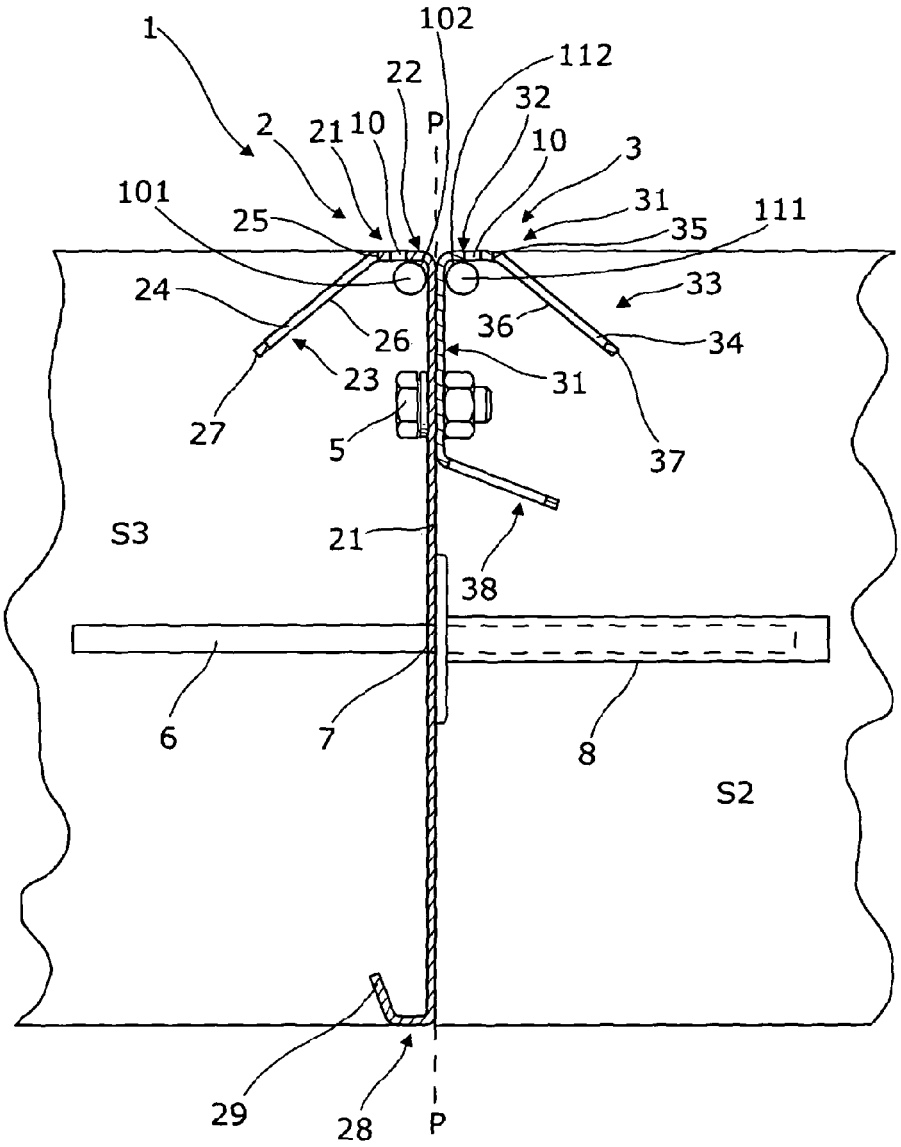
FIG. 1 is cross-sectional view of a joint including two anti-spalling edgings in accordance with the invention of Our '910, the edgings being improved in accordance with the present invention.
Figure 2:
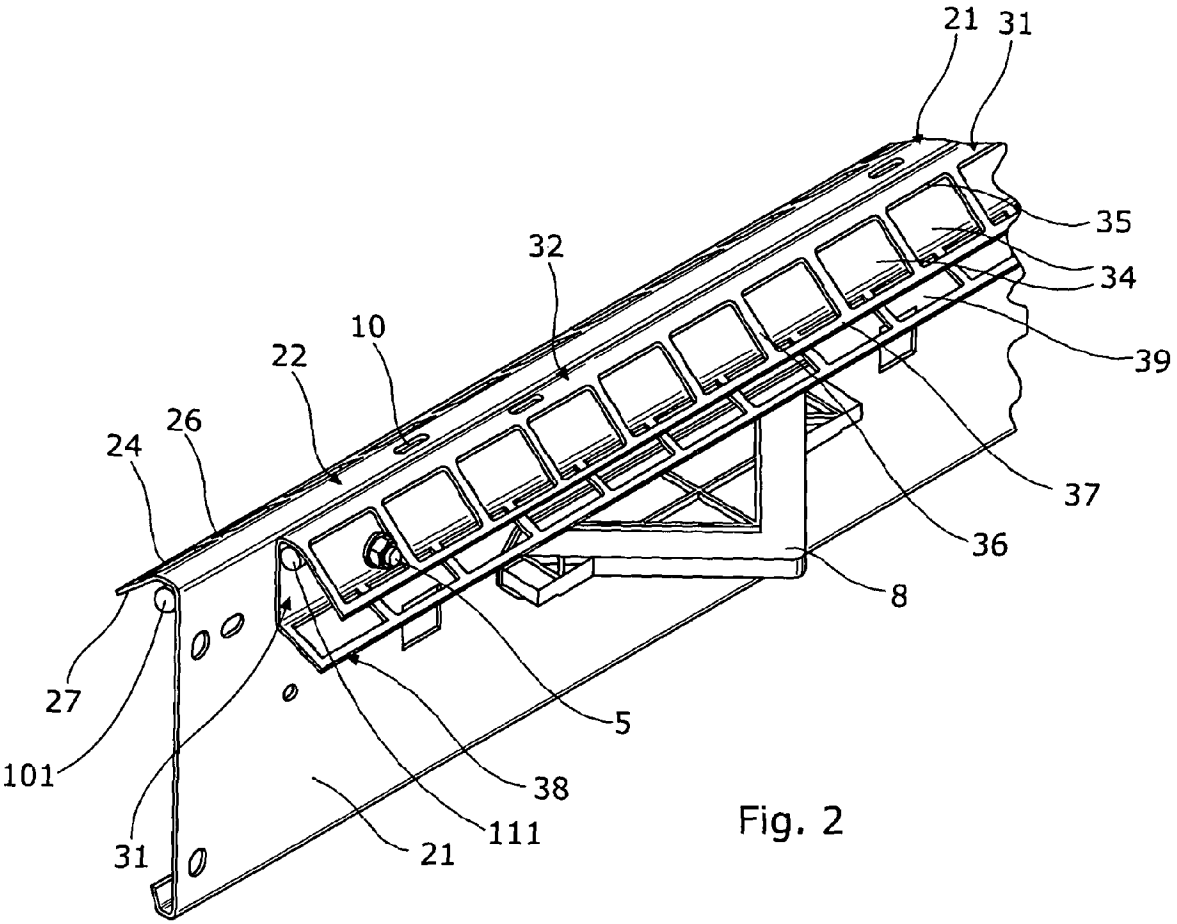
FIG. 2 is a perspective view of the joint.

Referring to the drawings, a joint 1 including a pair of anti-spalling edgings 2,3. Both have:

metal strips 21,31, the first being deep and the second being shallow, returns 22,32 along the top edges of the strips, facing in opposite directions from the central plane P of the joint, down-turns 23,33 extending down from the edges of the returns, cut-outs 24,34 in the down-turns, the cut-outs defining:

edges 25,35 in the returns which face outwards from the plane P, fingers 26,36 of the down-turns extending down between the edges, the fingers being narrow and the edges being wide, connections 27,37 at the bottom of the fingers.

The two anti-spalling edgings are lightly connected together with frangible fixings 5, below the level of the connections.

The deep metal strip 21 extends to or close to the base of the slab into which the joint is to be laid. It has a return 28 and up-stand 29 for stiffening it. These features are both optional and may be used separately. The shallow strip 31 also has a return 38, which is angled slightly away from the top return 32. The return 38 has a series of apertures 39. As shown these are of a similar size to the cut-outs 34, but they can be either large or more usually smaller. Beneath the return 38, the deep strip has flat plate dowels 6 welded to it at punched cut-outs 7. On the shallow strip side, the dowels are enclosed in sleeves 8, which allow the dowel to withdraw from the slab portion in which they extend. The dowels are not essential to the working of the invention, and embodiments can be envisaged without dowels.

In accordance with the present invention, lengths of reinforcing bar 101,111 are welded into the corners 102,112 between the metal strips 21,31 and the returns 22,32.

To install the joint, it is set up to form the edge of a slab portion S2, that is with the top of the return at the intended finished height of the slab. It can be temporarily secured by means that form no part of this invention. The slab portion is laid. Once it has cured to a green state, the temporary securement is removed and the portion S3 of the slab on the second side is laid. During laying, the concrete forms against the edges 25,35 in a manner that is not prone to spalling. The concrete is able to rise against the underside of the returns and the reinforcing bars 101,111, since air can flow out at the edges. Further air escape cut-outs 10 can be provided in the returns 22,32. Under heavy, repetitive loading, such as to cause break up to the top surfaces of the slabs, the returns 22,32 are supported at the original level of the top surfaces for appreciably longer than would be the case in the absence of the reinforcement provided by the reinforcing bars.

In our initial testing, we have used reinforcing bar that is substantially the same diameter, preferably 8-10 mm, as the width of the returns, with the radius of curvature of the corners matching that of the bar.

Figure 3:
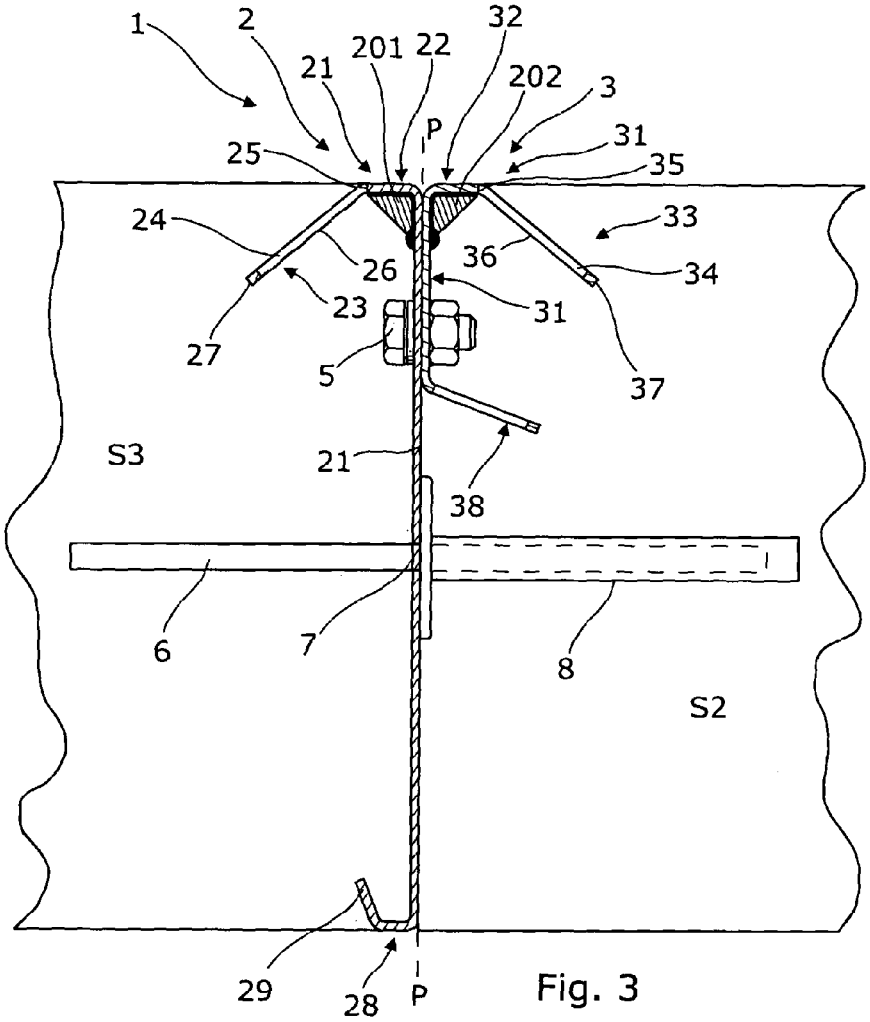
FIG. 3 is a view similar to FIG. 1 of another joint improved by reinforcement in accordance with the invention.
Figure 4:
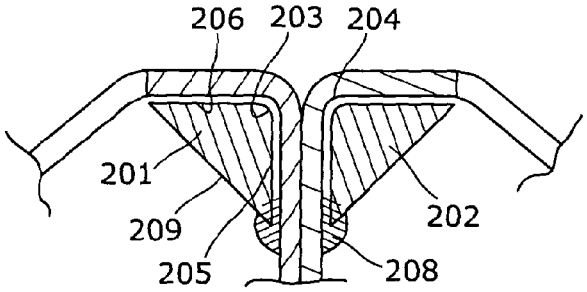
FIG. 4 is a scrap view of the reinforcement of the edgings of the joint of FIG. 3.
Figure 5:
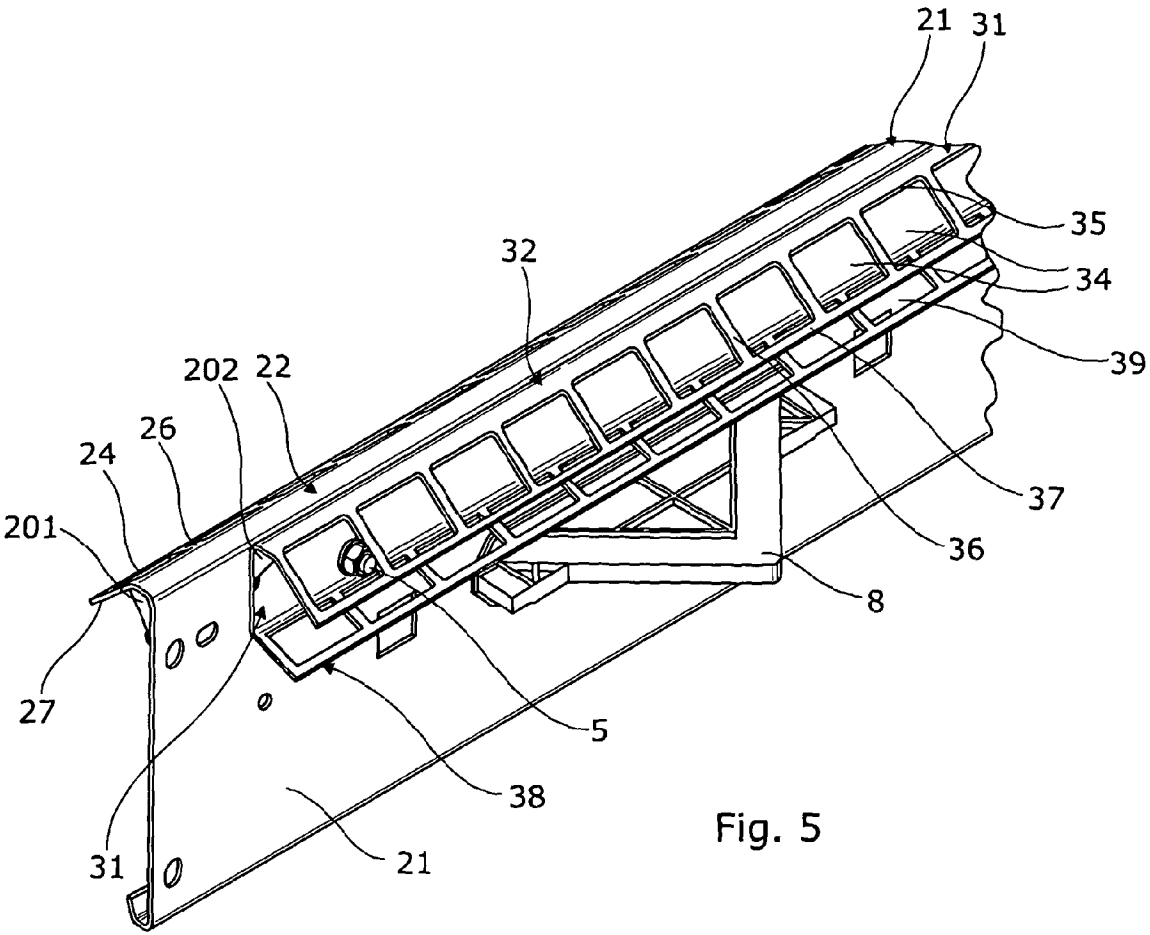
FIG. 5 is a view similar to FIG. 2 of the joint of FIG. 3.

Turning now to FIG. 3, there is shown an edging having alternative reinforcing members in the form of a triangular rolled steel fillet 201,202. The fillets have a radius of curvature 203 at their right angle corners complementary to that 204 of the corner of the edging between the strips 21,31 and the returns 22,32. The fillet's radius of curvature can be slightly larger, so as not to hold the fillet away from the corner of the edging, nor so much larger as to leave an appreciable gap allowing deformation of the edging in service. This can be achieved by arranging for the minimum of the tolerance range of the fillet's radius of curvature to exceed the maximum of the tolerance range of the radius of curvature of the corner. Thus one face 205 of the fillet abuts the strip and the other 206 abuts the return. The fillet is welded in place at intervals along its and the edging's length, as typically shown at 208. It is shaped to allow air rising during vibration of the poured concrete to rise up under the angled face 209 of the fillet and escape through the anti-spalling cut-outs 24,34. The cut-outs 10 in the return 22,32 would be obscured and are not provided. In the preferred embodiment, the face 209 is angled at 50° to the vertical in use, i.e. 50° to the metal strip abutted by the fillet's face 205. It could be angled from 65° to 15°, and particularly between 55° and 45°. 50° provides a compromise between economy of material and robust reinforcement.

Figure 6:
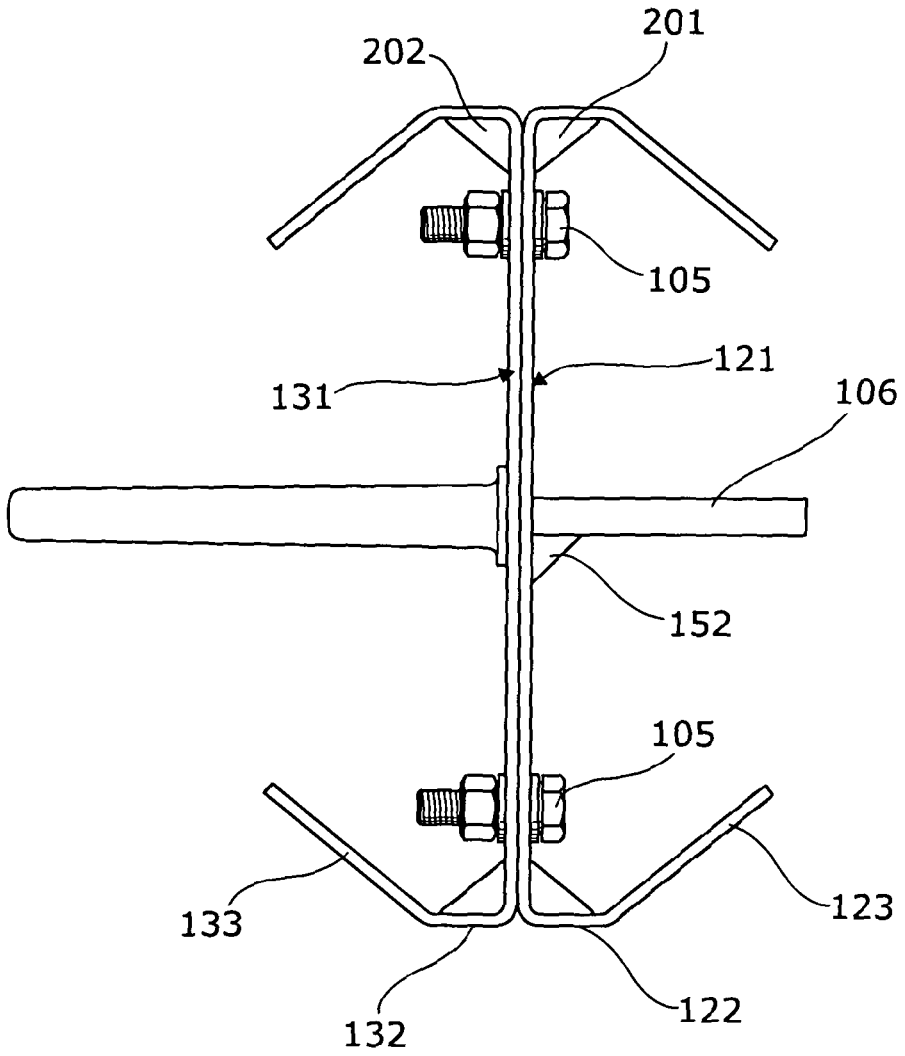
FIG. 6 is a view similar to FIG. 3 (but from the other end of the joint) of a modified improved joint and FIG. 7 is a view similar to FIG. 5 of the modified joint.
Figure 7:
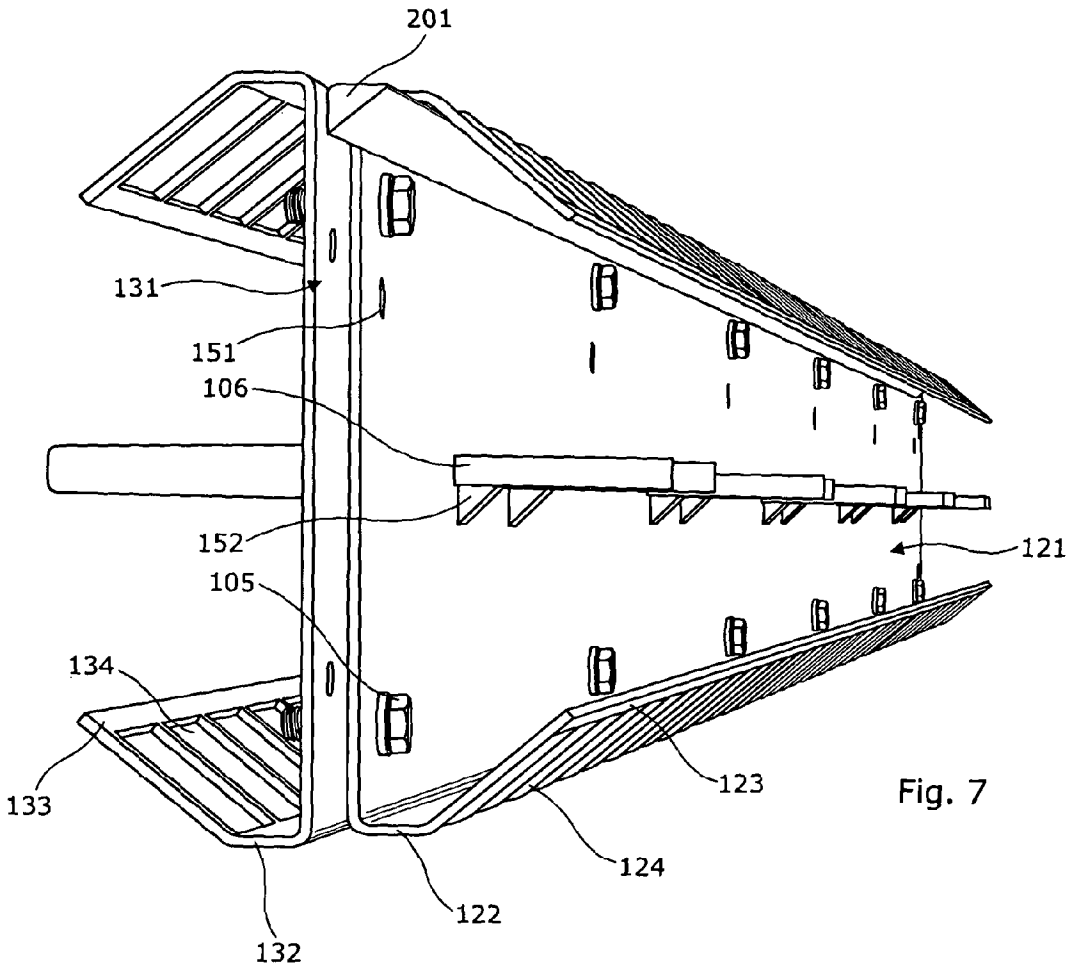

The invention is not intended to be restricted to the details of the above described embodiments. For instance, as shown in FIGS. 6 and 7, both strips 121, 131 are of the same depth, normally the full depth of the slabs. Thus both could have plain returns and up-stands as 28,29, but in practice, they have returns 122,132 along their bottom edges, up-turns 123,133 extending up from the edges of the returns and cut-outs 124, 134 in the up-turns. Two lines of frangible fixings 105 are provided. These modifications provides significantly more stiffness to the joint, which is advantageous in handling prior to installation. Whilst there is some scope for the joint to be placed upside-down, it is provided with a line of apertures 151 for known supports to hold the joint at installation height. Such support ensures that the joint is installed the right way up, with the reinforcing fillets uppermost.

One further modification is the provision of gussets 152 for assisting in ensuring that dowels 106 are welded square to the strips.

The invention claimed is:

1. An anti-spalling edging comprising:

a metal strip adapted for concrete to be cast against, a return along a top edge of the strip and forming a corner with the metal strip, a down-turn from the edge of the return spaced from the strip and cut-outs in the down-turn for anchoring it in the concrete and an elongate metallic member extending in the corner, fixed to the strip and/or the return for reinforcement of the anti-spalling edge at the corner.

2. An anti-spalling edging according to claim 1, wherein the cut-outs are so arranged as to provide faces, extending through the return and generally in the direction of the edging, against which faces the concrete abuts when cast level with the outer surface of the return.

3. An anti-spalling edging according to claim 1, wherein the reinforcing member is substantially as wide as the return.

4. An anti-spalling edging according to claim 1, wherein the elongate reinforcing member is fixed by welding.

5. An anti-spalling edging according to claim 1, wherein the elongate reinforcing member is of round bar.

6. An anti-spalling edging according to claim 1, wherein the elongate reinforcing member is of a cross-sectional shape complementary to the shape of the corner.

7. An anti-spalling edging according to claim 6, wherein the elongate reinforcing member is a triangular fillet having one face abutting the metal strip and another face abutting the return.

8. An anti-spalling edging according to claim 7, wherein the triangular fillet has a third face at between 55° and 45° to the metal strip.

9. An anti-spalling edging according to claim 1, further comprising a joint mechanism and dowel mechanism wherein frangible fixings connecting the edgings and dowel mechanism are attached to one of the edgings for vertical load transfer across the joint in use between concrete slabs cast on opposite sides thereof.

10. A joint according to claim 9 wherein one strip is deep and the other is shallower than the position of the dowels in the deep strip.

11. A joint according to claim 9 wherein the two strips are of equal depth and are each provided with two lines of frangible connectors and with returns and apertured up-turns at bottom edges.

* * * * *